United States Patent [19]

Chen

[11] 4,031,660

[45] June 28, 1977

[54] ILLUMINATED ACTION TOY

[76] Inventor: Tommy Chen, 10 Manwan Road 3 A, Kowloon, Hong Kong

[22] Filed: Oct. 12, 1976

[21] Appl. No.: 731,800

[52] U.S. Cl. ..... 46/228; 46/241
[51] Int. Cl.[2] ..... A63H 33/26
[58] Field of Search ..... 46/62, 228, 236, 241

[56] References Cited

UNITED STATES PATENTS

| | | | |
|---|---|---|---|
| 1,005,853 | 10/1911 | Lewis | 46/241 |
| 2,739,419 | 3/1956 | Cleveland | 46/62 X |
| 3,593,999 | 7/1971 | Kirk | 46/228 |

*Primary Examiner*—Louis G. Mancene
*Assistant Examiner*—Robert F. Cutting
*Attorney, Agent, or Firm*—Gottlieb, Rackman & Reisman

[57] ABSTRACT

There is disclosed a conventional-type action toy in which a moving element, e.g., a wheel, is provided with a magnetized axle which rotates and moves back and forth along essentially parallel metal rails. In the prior art, means have not been provided for illuminating the moving element by providing a bulb therein, primarily because of the difficulty of mounting batteries within the small-size element. In accordance with the principles of the invention, the batteries are mounted in a compartment to which the ends of the rails are connected, the ends of the rails being connected to terminals of opposite polarities. The bulb, mounted inside the moving element, is connected to the two ends of the magnetized axle which rotates along the rails. Current thus flows through the rails and the axle to the bulb.

15 Claims, 10 Drawing Figures

18
68
68a
60c
60
70
62
62b
60b
60a
72
62a
66
76
16b
16b'
16a
16a'
14a
14a'
14b
14b'
16
14
34b
38
34a
22b
22
54b
30d
54a
46
42
48b
50
48a
30e
30f
22a
26
40
44
32
24
82
80
74
70a

ILLUMINATED ACTION TOY

This invention relates to action toys, and more particularly to the illumination of an element which rolls back and forth along guide tracks.

A currently popular form of toy is that in which a wheel is provided with a magnetized axle which rotates along two substantially parallel steel rails. The rails are U-shaped so that as they are waved up and down by a child, the wheel rotates along the outer edges of the rails and then along the inner edges. Each rail flairs outwardly at its two ends so that the wheel axle can transfer from the outsides to the insides of the rails for continuous motion. A child holds the rails at one end and moves them up and down to impart motion to the wheel. It is the magnetized axle which causes the wheel to follow the rails.

In general, action toys have a much greater appeal if they are provided with a mechanism for controlling illumination. For this reason, it would be highly desirable to provide for the internal illumination of the wheel, with the wheel being made, for example, of translucent colored plastic. But it is exceedingly difficult to provide for the wheels to "light up" because there is no feasible way to attach wires to the wheel without interfering with the operation of the toy and, without wires, bulky batteries would have to be carried within the wheel itself. This would necessitate not only a larger size for the wheel, but would also require a more rigid wheel construction and one which would allow the batteries to be changed.

It is a general object of my invention to provide a mechanism for illuminating the inside of the wheel in the type of toy described above, without placing batteries within the wheel (or other moving element).

Briefly, in accordance with the principles of my invention, the rails and the axle are made of electrically conductive material such as steel. As in the prior art, the axle is magnetized so that the axle follows the rails. A battery pack is attached to the ends of the rails which are normally held by the child. Current flows from the battery pack along one rail to the end of the axle which moves along that rail. The current then flows through a bulb connected within the wheel to the two ends of the axle, and then along the other rail back to the battery pack. In this manner, the axle and the rails serve not only in their primary capacity of guiding the wheel and maintaining it in place on the rails, but they also serve to conduct current from an external battery pack to the bulb within the wheel. The fact that the axle is continuously rotating as it moves along the rails is immaterial; since contact is always made between the axle and both rails, there is a continuous current path so that the power for the bulb can be derived from an external battery pack.

Further objects, features and advantages of my invention will become apparent upon consideration of the following detailed description in conjunction with the drawing, in which.

Figures 1, 2, 3, 4, 8, 9, 10:
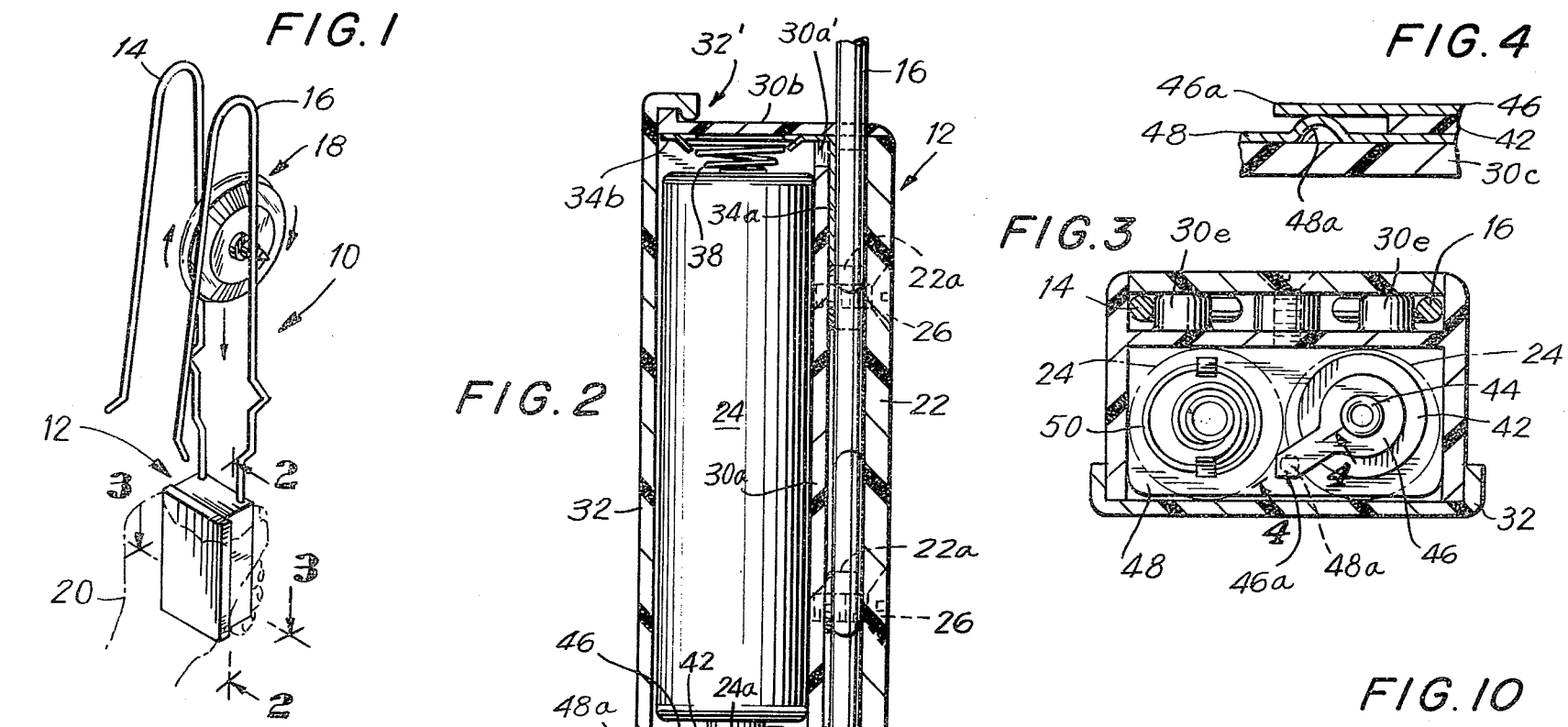
FIG. 1 depicts a perspective view of the toy of my invention.
FIG. 2 is a sectional view through the line 2—2 of FIG. 1.
FIG. 3 is a sectional view through the line 3—3 of FIG. 1.
FIG. 4 is a partial sectional view, taken through the line 4—4 of FIG. 3, depicting the operation of the on/off switch.
FIGS. 8, 9 and 10 depict three alternative moving elements which can be substituted for the wheel, each of such elements having a magnetized axle and a comparable internal construction including a bulb.
Figures 5, 6, 7:
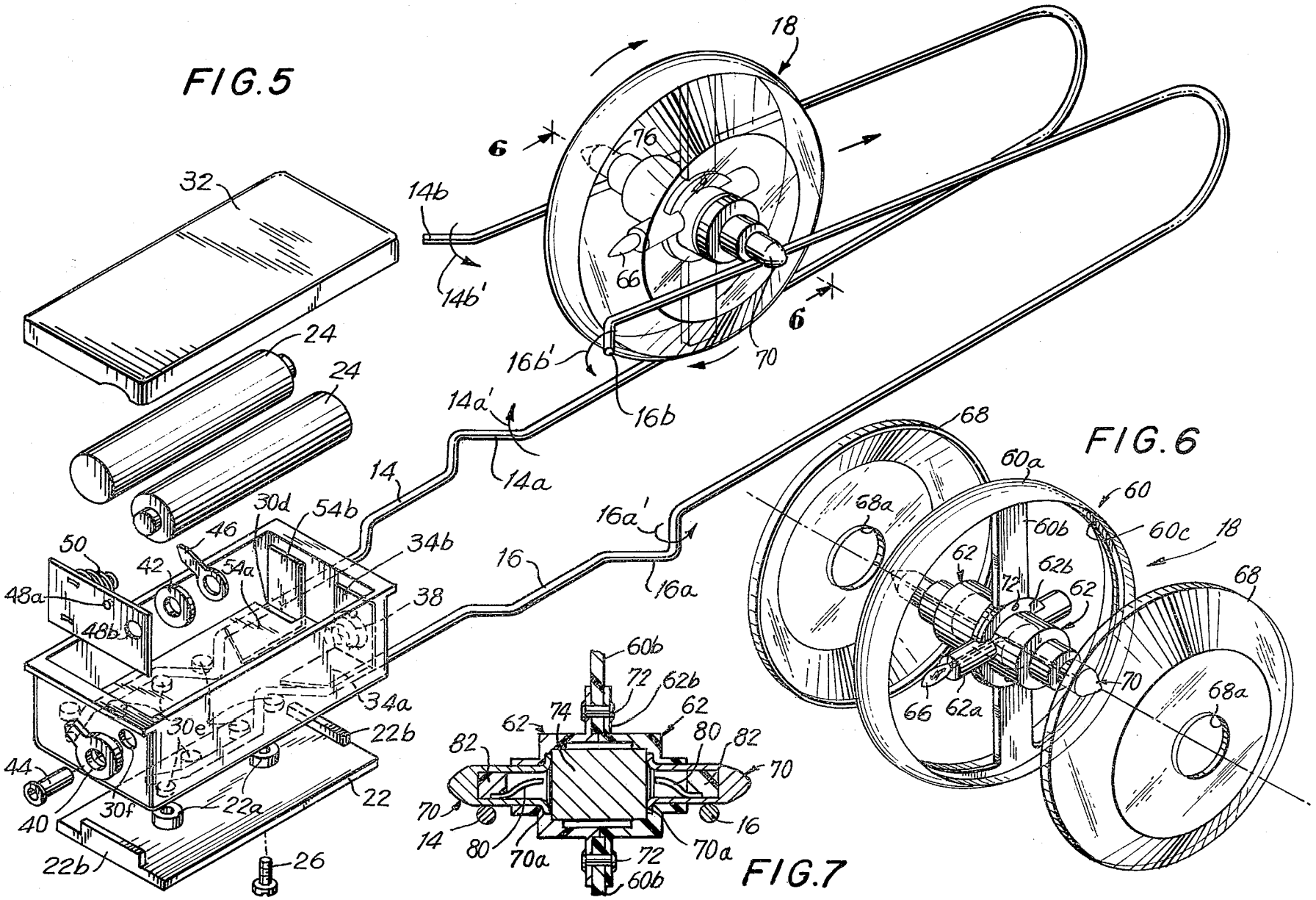
FIG. 5 is a perspective, partially exploded view of the toy.
FIG. 6 depicts a partially exploded view of the wheel.
FIG. 7 is a sectional view through the wheel.

Referring to FIGS. 1 and 5, the basic toy, of the prior art type, consists of two steel (or other magnetizable material) rails 14, 16 and a rotating wheel 18, the wheel being provided with a magnetized axle 70 for moving along the rails. The operative part of each rail insofar as the motion of the wheel is concerned, extends from one of the free ends **14*b*, 16*b* to the respective section labeled 14*a*, 16*a* in the drawing. The remainder of each rail serves to connect it to the battery pack 12 which is gripped by a child, the child's hand being shown by phantom lines 20 in FIG. 1. It is because sections 14*a*, 14*b*, 16*a* and 16*b*** are flaired away from the U-shaped rail sections that the wheel reverses direction and switches from the outsides of the rails to the insides, and vice versa.

Referring to FIG. 1, with the wheel axle on the outside of the rails and with the rails facing upwardly as shown, the wheel rotates in the clockwise direction and moves downward along the outside of the rails. As soon as the axle reaches flaired sections **14*a*, 16*a*, the axle moves around these sections toward the insides of the rails, as shown by arrows 14*a*', 16*a*'. The wheel, depending upon its momentum, may continue to move up along the insides of the rails and then downward. Alternatively, to insure that the wheel keeps moving, as soon as the wheel direction changes and starts to move upwardly, the child may move his wrist so that the rails face downwardly, in which case the wheel picks up speed at it now moves downwardly. By moving his wrist back and forth, the child may keep the wheel in constant motion. As the wheel continues to move around the curved ends of the rails, on the inside, it continues to move on the inside of the rails toward the free ends 14*b*, *l* 16*b*. The wheel then goes around the flaired ends (as shown by arrows 14*b*', 16*b*'**) and reverses direction, moving along the outside of the rails. This motion continues with the wheel axle switching between the insides and the outsides of the U-shaped rails at the flaired sections. The wheel turns due to the rotation of the axle along the rails, the axle also serving to secure the wheel to the rails as a result of its magnetization.

Rather than to connect the lower ends of the rails of FIG. 1 to a conventional spacer which can be held by the child, the rails are connected to a battery pack 12. The battery pack is shown in FIGS. 2–5. When the battery pack on/off switch 40 is turned on, a potential difference appears between the two rails and controls illumination of the wheel.

Battery pack housing 30 has two compartments separated by shelf **30*a*. The larger of the two compartments contains two batteries 24, and this compartment is covered by a snap-on lid 32. The lid has two tabs at its ends, as shown by the numerals 32' in FIG. 2, for snapping onto ridges at the ends of side panels 30*b*, 30*c* of the housing. On the other side of shelf 30*a* there is a smaller compartment in which the ends of rails 14, 16 are secured. The rails are held in place by a cover 22.**

The cover is positioned in the housing by lugs 22b (FIG. 5), is spaced from shelf 30a by integral spacers 22a, and is secured to the shelf by screws 26; the shelf is provided with two screw threads for this purpose. As shown in FIG. 5, the bottom of shelf 30a is provided with several lugs 30e for rigidly positioning the rails 14, 16 in place. Front wall 30b of the housing is provided with two holes 30d through which the rails extends out of the battery pack.

In order for the batteries to be connected to the rails, two bent contacts 34, 54 are provided. Contact 34 has two sections 34a, 34b. Section 34a bears against rail 16 underneath shelf 30a, and section 34b extends up into the battery compartment. A slit 30a' is provided at the forward end of shelf 30a so that contact 34 may extend from one compartment to the other. Similar remarks apply to sections 54a, 54b of the other contact and rail 14.

Within the battery compartment, spring 38 is secured to contact section 34b for engaging the negative terminal of one of batteries 24. The positive terminal 24a (FIG. 2) of this battery engages rivet 44, the rivet serving to interconnect wiper contact 46 and plastic switch 40 so that they rotate together.

As shown most clearly in FIG. 5, rivet 44 passes through plastic switch 40, hole 30f in the housing, hole 48b in metal plate 48, spacer 42 and the hole in wiper contact 46. (Hole 48b has a larger diameter than the rivet so that the rivet does not touch plate 48.) Contact plate 48 includes a dimple 48a which extends toward the pointed end of wiper contact 46. When plastic switch 40 is rotated in the counter-clock-wise direction of FIG. 5, wiper contact 46 moves with it so that the pointed end of the contact does not engage dimple 48a. In such a case, because wiper contact 46 and plate 48 are separated by spacer 42, the battery circuit is broken and no current flows through the rails and the wheel axle. It is only when switch 40 is moved clockwise so that the tip of wiper contact 46 engages dimple 48a that the circuit is completed. This is shown most clearly in the cross-sectional view of FIG. 4. Spring 50 is secured to plate 48 and engages the negative terminal of the other of the two batteries, with the positive terminal of this battery engaging contact section 54b. It is thus apparent that when the switch is turned on, there is a closed circuit which connects the batteries in series with the two rails.

The two springs can be secured to respective contact section 34b and plate 48 by conventional soldering, or by holes provided in the two contacts through which the wider end of each spring is inserted and secured in place.

The assembled wheel is shown in FIG. 5, FIG. 6 depicts the wheel with the two translucent covers 68 removed, and FIG. 7 is a cross-sectional view through the wheel showing its internal construction. The wheel includes a central section 60 with an outside hub 60a and two radially extending sections 60b. Along the inner surface of hub 60a there is a circular ledge 60c for separating the two covers 68. Each of the covers snap fits into the central section 60 within hub 60a, and may be glued if desired to secure the attachment. Each of the covers is preferably made of colored translucent plastic. In the illustrative embodiment of the invention, the covers are colored red. Each of the covers has a hole 68a through which a respective one of elements 62 can pass, as seen most clearly in FIG. 5.

To the free ends of radial sections 60b of the central element there are riveted two plastic sections 62. Each of these sections includes two flanges 62b, l each for bearing against the free end of one of the central spokes 60b. Rivets 72 serve to secure the two plastic sections 62 to the central element as shown most clearly in FIG. 7. Each of sections 62 also includes a semi-cylindrical extension 62a as seen most clearly in FIG. 6. A bulb 66 is held within the two facing sections 62a, with wires 80 from the bulb extending to the two ends of the axle as shown most clearly in FIG. 7.

The axle 70 itself consists of two identical parts, each being a cylindrically-shaped hollow steel pin with a flaired end 70a for securement within a respective one of sections 62. A force-fit plastic insert 82 serves to maintain one of wires 80 against the inside surface of each hollow pin so that electrical contact is made between each half of the overall axle and one of the wires extended to the bulb. A permanent magnet 74 is held in place between the flaired ends of the two steel pins 70. It is the flux from this permanent magnet which magnetizes the two halves of the axle. The two pins 70 thus serve not only to maintain the wheel in place on the rails 14, 16, but also to conduct current from the rails to bulb wires 80. Although magnet 74 is connected between the two pins 70 in parallel with the bulb, the resistance of the magnet is so much greater than that of the bulb that substantially all of the battery current flows through the bulb and is diverted from the magnet.

Instead of proving the moving element in the form of a wheel, other shapes are possible. Three preferred examples are shown in FIGS. 8, 9 and 10 — an airplane, a car and a railroad engine — all vehicles of the type with which childern enjoy playing. In each case, the moving element is provided with a magnetized, electrically conductive axle 70 for moving along the rails. The internal construction of each of these three moving elements includes those parts depicted in FIG. 7, namely, a permanent magnet for magnetizing the two halves of the axle and a means for conducting current to a bulb between the two halves of the axle. The moving element in each case should be made of transparent or translucent material so that the illumination inside the element can be observed.

Although the invention has been described with reference to particular embodiments, it is to be understood that these embodiments are merely illustrative of the application of the principles of the application. Numerous modifications may be made therein and other arrangements may be devised without departing from the spirit and scope of the invention.

What I claimed is:

1. An illuminated action toy comprising a pair of substantially parallel rails made of magnetic and electrically conductive material, each of said rails having two outwardly flaired sections facing two outwardly flaired sections in the other rail, a moving element having an axle whose ends are magnetized and electrically conductive for rotating and moving along said rails and for reversing direction at the flaired sections thereof, and battery pack means secured to said rails for spacing said rails from each other to accommodate said axle therebetween and for applying a potential difference to said rails, said moving element including bulb means connected between the two ends of said axle whereby said axle controls both attraction of the moving element to the rails and the flow of current from one rail through the bulb to the other rail.

2. An illuminated action toy in accordance with claim 1 wherein said battery pack means includes a switch for selectively controlling the application of said potential difference to said rails.

3. An illuminated action toy in accordance with claim 2 wherein said moving element includes a section of colored translucent material on each side thereof for allowing an observer to view the illumination of the bulb means therein.

4. An illuminated action toy in accordance with claim 3 wherein said axle includes two pins made of magnetic and electrically conductive material, and a non-conductive permanent magnet secured therebetween, and further including a pair of wires for connecting the terminals of said bulb means to respective ones of said pins.

5. An illuminated action toy in accordance with claim 4 wherein said moving element has the configuration of a wheel.

6. An illuminated action toy in accordance with claim 4 wherein said moving element has the configuration of a vehicle.

7. An illuminated action toy in accordance with claim 2 wherein said axle includes two pins made of magnetic and electrically conductive material, and a non-conductive permanent magnet secured therebetween, and further including a pair of wires for connecting the terminals of said bulb means to respective ones of said pins.

8. An illuminated action toy in accordance with claim 1 wherein said axle includes two pins made of magnetic and electrically conductive material, and a non-conductive permanent magnet secured therebetween, and further including a pair of wires for connecting the terminals of said bulb means to respective ones of said pins.

9. An illuminated action toy in accordance with claim 8 wherein said moving element has the configuration of a vehicle.

10. An illuminated action toy in accordance with claim 8 wherein said moving element has the configuration of a vehicle.

11. An illuminated action toy in accordance with claim 1 wherein said moving element has the configuration of a wheel.

12. An illuminated action toy in accordance with claim 1 wherein said moving element has the configuration of a vehicle.

13. An illuminated action toy in accordance with claim 1 wherein said moving element includes a section of colored translucent material on each side thereof for allowing an observer tc view the illumination of the bulb means therein.

14. An illuminated action toy in accordance with claim 13 wherein said moving element has the configuration of a wheel.

15. An illuminated action toy in accordance with claim 13 wherein said moving element has the configuration of a vehicle.

* * * * *